United States Patent [19]

Eckelmann

[11] 4,373,900

[45] Feb. 15, 1983

[54] BURNER FOR A KILN

[75] Inventor: Günther Eckelmann, Niedernhausen, Fed. Rep. of Germany

[73] Assignee: Pillard, Inc., Richmond, Va.

[21] Appl. No.: 96,813

[22] Filed: Nov. 23, 1979

[51] Int. Cl.[3] ..... F23M 9/00

[52] U.S. Cl. ..... 431/182; 431/185; 431/188; 431/353; 239/400; 239/403; 239/416; 110/263

[58] Field of Search ..... 431/8, 185, 182, 186, 431/187, 188, 190, 285, 353; 239/400, 403, 416, 416.5, 417, 422, 424, 438; 110/263, 265, 347

[56] References Cited

U.S. PATENT DOCUMENTS 4,157,889 6/1979 Bonnel ..... 431/182
4,208,180 6/1980 Nakayasu et al. ..... 239/404 X

FOREIGN PATENT DOCUMENTS 1926353 1/1970 Fed. Rep. of Germany ..... 431/187
2816643 10/1979 Fed. Rep. of Germany ..... 239/417
54-129536 10/1979 Japan ..... 431/187

*Primary Examiner*—Samuel Scott
*Assistant Examiner*—Margaret A. Focarino
*Attorney, Agent, or Firm*—Kenyon & Kenyon

[57] ABSTRACT

A burner for pulverized coal such as in a rotary kiln includes three concentric cylindrical ducts. The outer duct carries an air supply which is directed in a generally axial direction into the kiln. The next innermost duct carries the pulverized coal-carrier gas mixture and is also generally directed in an axial direction. The next innermost duct carries air which is directed in a divergent radial direction in the kiln and includes a rotational air component. By controlling the quantities of air in the ducts which flank the coal duct, the resulting flame form can be controlled in the kiln without restoring to variations in the velocity or direction of the coal carrier gas stream. By eliminating such variations in regard to the coal carrier gas stream, the abrasive action of the pulverized coal is kept to a minimum.

12 Claims, 2 Drawing Figures

BURNER FOR A KILN

Figure 1:
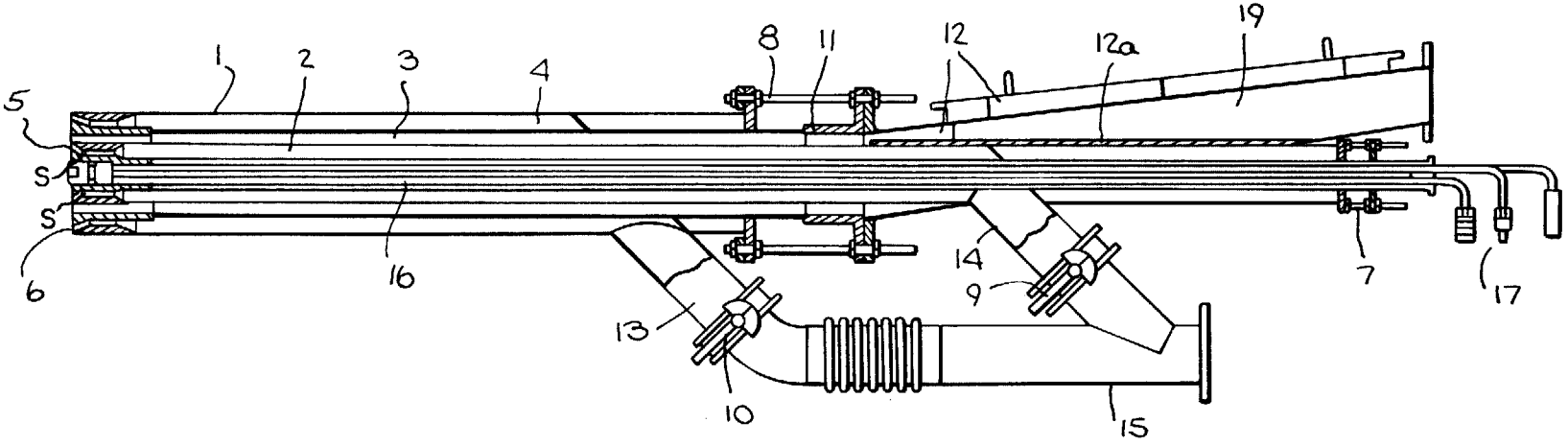

The invention concerns a burner for a rotary kiln. More particularly, this invention relates to a burner for a rotary kiln which can burn and produce an adjustable flame.

Heretofore, burners have been known which are constructed to convey a flow of a pulverized coal-carrier air mixture through a pipe and to eject the coal at an outlet with a second pipe concentrically within the pulverized coal pipe to simultaneously eject a flow of air.

In this construction, the ejected air is enveloped circumferentially by the combusting coal.

It has also been known that the materials processed in a rotary kiln sometimes require an adjustment of the heat source. To this end, the burners of the above type have been provided with controls to adjust the velocity of the supplied pulverized coal-carrier air mixture, for example to change the flame form in the longitudinal direction. However, as the velocities in such a burner are relatively high, adjustments of this nature can cause difficulties due to the extremely abrasive nature of pulverized coal. That is, such a variation in velocity can entail dire consequences since the velocity of the coal would necessarily be increased, thus substantially increasing the abrasive action of the coal throughout the burner.

Accordingly, it is an object of the invention to adjust the flame form in a pulverized coal burner without varying the magnitude of velocity of the supplied pulverized coal.

It is another object of the invention to maintain the velocity of a supplied pulverized coal-air mixture at a minimum value to maintain abrasion at a minimum.

Briefly, the invention provides, a burner for a kiln which includes three concentric cylinders of ducts. The outermost and innermost of these ducts are used for supplying a part of the combustion air to a combustion zone of the kiln while the duct which is situated between these two air ducts is used for supplying pulverized coal which is carried along by a suitable carrier gas, such as air.

The inner and outer air ducts which flank the central coal duct serve to give directional components to the air which leaves these ducts. The outer air duct directs air in a generally axial direction while the inner air duct directs air in a generally radial direction with a component of rotation. The coal duct stream is directed in a generally axial direction.

By increasing the quantity of air exiting from the inner air duct, which is directed in a radial direction, a flame pattern can be obtained which is expanded in the radial direction. If, on the other hand, the quantity of air supplied by the outermost air duct is increased, a flame form is obtained which is generally elongated and limited in radial expanse.

Since flame form is adjusted by means of adjustments made in regard to the air duct streams, there is no need to adjust the velocity or direction of the coal pulverized stream. The coal stream can thereby be maintained at a relatively low velocity just sufficient to carry the pulverized coal and to prevent backfiring into the burner nozzle. Further, the direction of travel of the coal stream need not be changed in order to change flame form. Since increased velocity of the coal stream also entails abrasion of the surface which causes the change in direction, by limiting the coal stream to a minimum velocity, abrasion will be kept to a minimum in the burner.

Since the coal duct is flanked on either side by the inner and outer air ducts, even if there were deterioration in the coal stream duct walls, causing leakage of the pulverized coal mixture, this leakage would only be into the flanking air duct streams. Thus, leakage would not be introduced into the centermost chamber of the burner, which may contain preheating fuel supplies, nor would this leakage be external to the outer wall of the burner.

In one embodiment, a means is provided to longitudinally adjust the outer and inner walls of the air ducts relative to each other so as to increase or decrease the relative cross-sectional area of the duct output nozzles.

In another embodiment, the burner is provided with a swirl means at the outlet of the innermost air duct for imparting a swirling effect to the expelled air flow. In addition, a means is provided for adjusting the air flows in the two air ducts to adjust the shape of the flame extending from the coal duct. This means includes a connection piece which is connected in common to each of the air ducts to deliver air thereto, and valves between the connection pieces and each air duct to control the flow of air in each air duct.

The burner may also be provided with a fourth pipe centrally of the inner air duct for housing at least one conduit for conveying oil or other fuel. This conduit has an outlet to expel this other fuel at the end of the inner air duct, for example, for pre-heating or ignition purposes as is known.

Replaceable protective parts can also be provided in the coal duct at these points where the coal flow changes direction. These replaceable protective parts are used to protect against the abrasive action of the coal caused upon impact on the direction changing surfaces.

Figure 2:
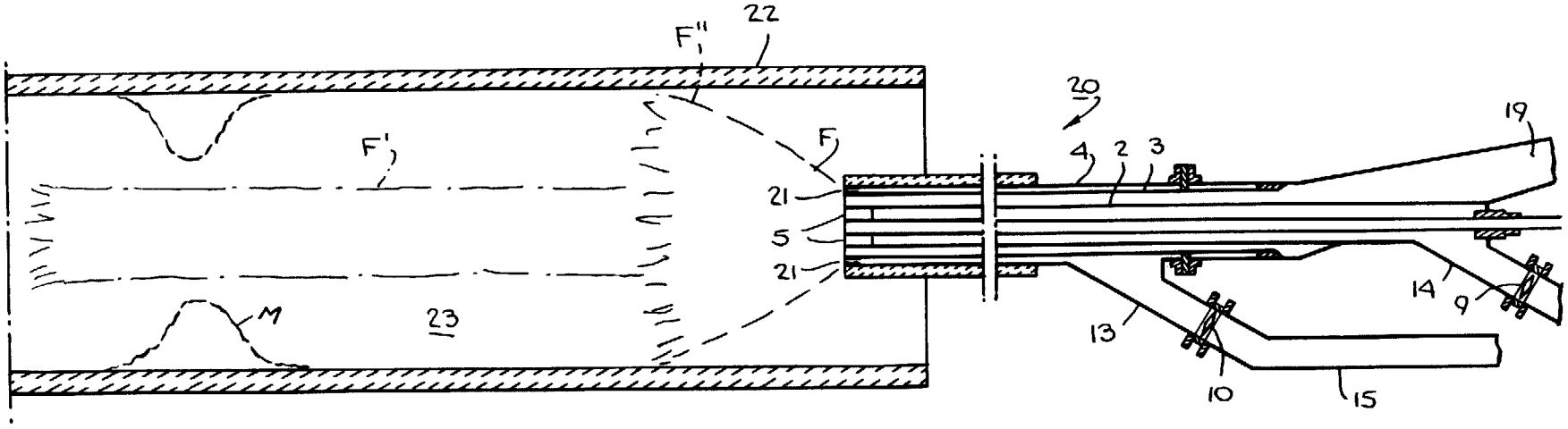

These and other objects and advantages of the invention will become more apparent from the following detailed description and appended claims taken in conjunction with the accompanying drawings in which:

FIG. 1 illustrates a longitudinal cross-sectional view of a burner for a rotary kiln according to the invention; and FIG. 2 illustrates a cross-sectional view of a burner according to the invention located within a rotary kiln.

Referring to FIG. 1, the burner 1 includes a number of concentric ducts 2, 3, 4.

The outermost duct 4 carries air into a kiln (not shown) to which air is supplied by an air supply pipe 13. The air which is fed from the supply pipe 13 will be fed only to the outer duct 4 in an axial direction parallel to the longitudinal axis or, as viewed in FIG. 1, in general axial direction but directed slightly in the radial direction. The radial component of direction of the nozzle 6 is exaggerated in FIG. 1 and would be in fact quite slight or even non-existent.

The next innermost duct 3 carries pulverised coal which is mixed with air or possibly some other carrier gas and directs the coal-air mixture in a generally axial direction into the kiln (not shown).

The next innermost duct 2 like the outer duct 4, carries air which is used to feed the combustion process and to control the resulting flame form. The air in the duct 2 exits via an annular outlet of a nozzle 5 at the terminal end which, as seen in the FIG. 1, is sharply inclined in the radial direction i.e., directed in a diverging direction. The inclination in the radial direction is much more pronounced than that of the nozzle 6. Indeed, as mentioned, nozzle 6 can be directed in the axial or longitudinal direction having no radial component and, to the extent that a radial component is given to the nozzle 6 air-stream, this component would be small compared with that of nozzle 5. The nozzle 5 is also equipped with a well-known swirl means, such as an inclined blade or vane arrangement, called a "swirler" for imparting a general rotational component to the air which is fed into the kiln chamber by the duct 2. The air in the duct 2 is supplied through an air supply pipe 14.

As shown, the air supply pipes 13 and 14 are both commonly connected to a general air supply input pipe or connection piece 15. The mixture of pulverized coal and carrier gas is supplied to the duct 3 by an input duct 19.

One or more conduits 16, 17 which can be used for supplying a second fuel to the kiln, are disposed at the central portion of the burner within the innermost duct 2. In the case of oil, two conduits are used. In the case where other fuels are used, the number and types of conduits are adapted to the kind of fuel used. The conduits 16, 17 can be used to preheat the kiln preparatory to commencing operation with coal being used as the steady state combustible agent. The fuel supply conduits 16, 17 are normally not in operation during combustion of the pulverized coal but are rather used to prepare the kiln for the coal burning process and for ignition purposes. In those cases where combustion is difficult to maintain, the fuel supply via the conduits 16, 17 could be used continuously during combustion. It is also possible to use the second fuel alone to fire the kiln. The fact that the preheating fuel conduit 16 is located at the center of the burner entails that the heating-up of the kiln by the fuel will be general and will not be localized as would be the case if the fuel conduit 16 were brought into the kiln at some other non-central point.

The form of the flame can be influenced by controlling the relative amounts of air which are fed to the burner through the supply pipes 13, 14. To this end, control valves 9, 10 are positioned between the connection piece 15 and each air duct 2, 4. As the air supply from the pipe 14 which passes through the duct 2 and nozzle 5 is directed in an outward direction and has a rotational component imparted to the air by the swirler in nozzle 5, the pulverized coal mixture is blown in an outer direction. This causes the resulting flame to be expanded in the radial direction. By increasing the amount of air supplied through the outer duct 4, the flame will tend to be directed in an axial or longitudinal direction since the nozzle 6 is directed essentially in the axial or longitudinal direction, although it may have radial components which would be slight in comparison to those of nozzle 5. Thus, if the air supplied through the duct 2 is held relatively small in comparison with the air supplied in the duct 4, the flame tends to be directed in the axial or longitudinal direction and would not be enlarged in the radial direction. If, however, the air supplied through the duct 4 is small in comparison with the air supplied through the duct 2, the flame takes on a greater radial component and evidences a shorter, wider flame form. By adjusting the air supplied by the valves 9, 10, the flame can be adjusted to have the shape which is most desirable.

An optional adjustability feature can be supplied by the use of means for altering the cross-sectional areas of nozzle 5 and/or 6. This can be accomplished by adjusting screws 7, 8 which can be used to slide the concentric ducts relative to each other in a longitudinal direction. For example, by adjusting one screw 8, the outer wall of the duct 4 can be withdrawn, or moved to the right as viewed, relative to inner wall of the duct 4. This, of course, will have the effect of increasing the cross-sectional area of the nozzle 6 and ultimately altering the resultant flame form. The same adjustability feature could be carried out in regard to the inner wall of the duct 2 relative to the outer wall of the duct 2 by means of the other screw 7.

Abrasion protective elements 12 could be installed at locations where the pulverized coal streams will be turned or will be likely to make direct contact with a surface. Since the pulverized coal is very abrasive, these elements can be inserted to take the brunt of the abrasive action. Preferably, these elements are installed so that they can be exchanged as they become worn away by the abrasive action of the coal. The coal stream enters the system through the supply duct 19 and directly impacts on a surface which would normally be the outer wall of the air duct 2 which could be quickly worn away by the abrasive action of the coal. A protective piece 12*a*, of any relatively abrasion resistive material, is preferably mounted to prevent this damage. Similar protective pieces could be used wherever the coal stream is to change direction.

An additional swirler 11 is also provided in the coal duct. As the coal is fed to the burner by the supply duct 19, the coal powder will slowly settle to the lower regions of the stream due to the effects of gravity. The swirler 11 will counter this undesirable settling action by mixing the coal powder and uniformly distributing the powder in the carrier gas stream of the duct 2. This insures a more uniform burning action when the stream enters the kiln. The swirler 11, like that in nozzle 5, includes well-known vanes or blades which give a rotational component to the gas mixture which passes through the swirler.

Referring to FIG. 2, wherein like reference characters indicate like parts as above, the burner 20 may be constructed so that the innermost duct 2 has a swirl means 5 at the outlet end for imparting a swirling motion to the air while the outermost air duct 4 has a nozzle 21 for ejecting air axially. The nozzle 21 can be constructed in any suitable manner so as to provide a reduced cross-sectional area for the outflow of air.

As shown, the burner 20 is mounted within a rotary kiln 22 so as to project into an elongated combustion zone or heating chamber 23 of the kiln 22.

When in operation, the burner 20 emits a flame F of a chosen shape. In the event that it becomes necessary to change the shape of the flame due to the type of material M which is being processed within the kiln 22, the air flows in the respective ducts 2, 4 are adjusted by controlling one or both of the valves 9, 10. The flame F can then be varied so as to form, for example an elongated flame F′ indicated in dotted line or a flared conical shape flame of short length F″ as indicated in dot dash lines. The flame can be varied within these two extremes to adapt to the heating requirements for the material being processed in the kiln.

One of the advantages of the burner is that the form of the flame produced is principally influenced by the air streams which are arranged on either side of the pulverized coal stream. This means that the adjustments in the flame form can be carried out without varying the velocity or direction of the abrasive coal-air stream.

This feature is important, since, due to the abrasive action of the coal stream, if the coal stream has to be altered in direction or velocity, the abrasive action of the coal stream would be increased. This is so since, for example, if the coal stream is directed in an outwardly radial direction at one point in time and perhaps in a different direction at a second point in time, this would have to be done by placing directing means in the path of the moving pulverized coal and these directing means would be subjected to increased abrasive action. Similarly, if flame adjustments were carried out by varying the velocity of the coal stream, this would necessarily entail that the velocity would be increased for some situations which would cause increased abrasion. By carrying out adjustments to flame form with the air streams in the ducts 2, 4, the velocity of the powdered coal stream can be maintained at a minimum magnitude and thereby abrasion can be kept to a minimum.

The actual velocity of the coal air stream would depend upon the parameters of the particular system and the type of coal used. The velocity should, however, be kept to a minimum value in order to keep abrasion minimum. The minimum velocity generally would be that which is just sufficient to carry the coal powder, and this in turn would depend upon the fineness of the powder. A representative value for velocity would be approximately 45 to 60 feet per second for a pulverized coal in which 88% of the coal is composed of particles 90 microns or smaller in diameter.

Therefore, the invention aleviates one of the difficulties in dealing with pulverized coal burners wherein the abrasive nature of the fuel entails that there will be limited possibilities in flame form adjustment. Because of the particular arrangement of the burner, the abrasive action of the coal is further minimized because of the fact that a lower speed can be used for the coal carrier gas mixture, with the lower limit on velocity being just sufficient to carry the coal and to prevent back-flaming into the coal duct. The coal velocity need not be increased to obtain some particular flame form as this will be accomplished by means of proper adjustment of the air ducts which flank the coal duct.

Since the speed of the air carried coal is relatively low, the coal will automatically ignite immediately on leaving the burner.

The fact that the coal duct is located between two air ducts entails the advantage that, even in the case of serious abrasion, neither the outer pipe surface nor the inner pipe surface, which shields the central preheated fuel conduits, could be damaged.

Separate pneumatic systems for supplying pulverized coal can be connected to the coal duct so that different sorts of pulverized coal can be used. In addition, it will be easier to switch to other different forms of solid fuels since the adjustment mechanism for the flame form is principally independent of the coal duct and alterations in the coal duct for purposes of flame adjustability in view of the fuel changeover will normally not be necessary. Also, if other sorts of fuel, such as fluid or gas fuel, which would have very different burning characteristics and which would entail substantial changes in heat presentation, were used, the changes in heating characteristics can be more easily compensated for by adjusting the flame form by using the air component ducts.

The embodiments of the invention in which an inclusive property or priviledge is claimed are defined as follows:

1. A burner for a kiln comprising a first duct for conveying an air flow, said first duct having an annular outlet at a terminal end directed in a diverging direction to expel the air flow in a radially outward direction;

swirl means at said outlet of said duct for imparting a swirling effect to the expelled air flow;

a second duct concentric to and about said first duct for conveying a flow of pulverized coal, said second duct having an outlet at one end to expel the pulverized coal into a flame;

a third duct concentric to and about said first and second ducts for conveying an air flow, said third duct having an outlet concentric to and about said first duct outlet for expelling an air flow with an axial component; and means for adjusting the air flows in said first and third ducts to adjust the shape of the flame extending from said second duct between an elongated shape and a flared conical shape.

2. A burner as set forth in claim 1 wherein said means includes a first valve for controlling the air flow in said first duct and a second valve for controlling the air flow in said third duct.

3. A burner as set forth in claim 1 which further comprises a connection piece connected in common to each of said first and third ducts to deliver air thereto.

4. A burner as set forth in claim 3 wherein said means includes a first valve between said connection piece and said first duct to control the flow of air in said first duct and a second valve between said connection piece and said third duct to control the flow of air in said third duct.

5. A burner as set forth in claim 1 which further comprises a pipe centrally of said first duct for housing at least one conduit for conveying a fuel therethrough, said conduit having an outlet to expel the fuel at said one end of said first duct.

6. In a powdered coal burner first means for supplying supply air in a generally axial direction, second means for supplying a powdered coal-carrier gas mixture at a constant minimum velocity concentrically within the supplied supply air, third means for supplying air concentrically within the powdered coal carrier gas mixture and in a generally radial direction relative to said generally axial direction of said first means, said first, second and third means including concentric ducts with said first means being the outermost duct with an outlet to expel air with an axial component, the third means being the innermost duct having an annular outlet at a terminal end directed in a diverging direction to expel the air flow in a radially outward direction, and said second means being located between said first and third means, means for adjusting the flame form produced by combusting the powdered coal mixture supplied by said second means without altering the velocity or direction of the powdered coal carrier gas mixture, said adjusting means including means for regulating the quantity of air entered into said first and third supply means; and swirl means for imparting a rotational component to the air supplied by said third means.

7. In a burner as set forth in claim 6, a second swirl means located in said second supply means for mixing the powdered coal carrier gas mixture.

8. In a burner as set forth in claim 6, a fuel supply means located centrally and radially inwardly of said third supply means.

9. In a burner as set forth in claim 6 wherein said first supply means includes an inner and outer wall and which further comprises means for moving said outer wall relative to said inner wall.

10. In a burner as set forth in claim 6 wherein said third supply means includes a first and a second wall and which further comprises means for moving said first and second walls relative to each other.

11. In combination with a kiln defining a combustion zone; a burner at one end of said zone for introducing a flame into said zone, said burner comprising a first duct for introducing pulverized coal into said zone at a given supply rate to generate a flame within said zone to extend from said end of said zone, and means for adjusting the shape of the flame within said zone between an elongated shape and a flared conical shape without altering said supply rate of pulverized coal, said means including a second duct for conveying an air flow concentrically within said first duct and a third duct for conveying an air flow concentrically about said first duct, said second duct having an annular outlet directed in a diverging direction to expel the air flow in a radially outward direction and said third duct having an outlet to expel an air flow with an axial component.

12. The combination as set forth in claim 11 wherein said means further includes swirl means in said second duct for imparting a swirling effect to the expelled air flow and means for adjusting the air flows in said second and third ducts to adjust the shape of the flame extending from said burner.

* * * * *